United States Patent [19]

Davidson

[11] 4,204,373

[45] May 27, 1980

[54] COMPRESSED EXPANDABLE INSULATION TAPE AND METHOD

[76] Inventor: James D. Davidson, 67 Grantour Ct., Pontiac, Mich. 48055

[21] Appl. No.: 940,720

[22] Filed: Sep. 8, 1978

[51] Int. Cl.[2] ..... E04B 1/74; E06B 1/04

[52] U.S. Cl. ..... 52/204; 52/127; 52/98; 52/173 R; 428/310; 428/315; 52/741

[58] Field of Search ..... 52/127, 98, 173, 404, 52/204, 741, 746; 206/616, 601, 604, 605, 615, 617; 277/228, 229, DIG. 10; 49/485; 428/310, 315

[56] References Cited

U.S. PATENT DOCUMENTS

| | | | |
|---|---|---|---|
| 1,868,080 | 7/1932 | Slater et al. | 49/485 |
| 1,960,137 | 5/1934 | Brown | 428/310 |
| 2,102,858 | 12/1937 | Schlumbohm | 206/616 |
| 2,103,003 | 12/1937 | Fischer | 428/315 |
| 2,419,322 | 4/1947 | Matheny | 428/315 |
| 3,124,850 | 3/1964 | Johnson | 49/485 |
| 3,333,725 | 8/1967 | Hirata et al. | 277/229 |
| 4,076,262 | 2/1978 | Deventer | 277/229 |
| 4,126,966 | 11/1978 | Lobell | 428/315 |

*Primary Examiner*—James L. Ridgill, Jr.

[57] ABSTRACT

A method of providing thermal insulation in relatively small spaces, such as the spaces between window and door frames and the structural members forming the rough openings therefor, comprises use of a prefabricated compressed-insulation tape, which may be secured at the factory to the outer periphery of the window or door frame, or to the inner periphery of the rough opening on the building site, the tape comprising a strip of any suitable compressible insulation material, such as spun glass or polyurethane, for example, retained in a compressed state by means such as a paper or plastic envelope, the envelope having at least one rip cord, whereby when the rip cord is pulled after installation of the window or door frame to rip the envelope longitudinally off the tape, the compressed insulation expands to fill the air gap space between the frame and the rough opening structure to provide thermal insulation therefor.

15 Claims, 9 Drawing Figures

COMPRESSED EXPANDABLE INSULATION TAPE AND METHOD

BRIEF SUMMARY OF THE INVENTION

This invention relates generally to thermal insulation, and more particularly to a method and material for insulating, as in construction of a home, for example, the usual relatively narrow space between window and door frames and the structural members forming the rough opening therefor.

All home construction, due to the method used to install wood or other window and door frames, results in an air gap of ½"-1" around the window or door frame.

Particularly in view of the energy crisis, and the resulting serious need to conserve energy, to reduce fuel bills, etc., it is getting more and more important that these window and door frame and other similar air gaps be insulated against heat transfer and infiltration. That is, these air gaps should be filled with a thermal insulation. However, checking new homes under construction dramatically indicates that this is not being done. The end result is that in most homes, as utility companies have agreed, a substantial percentage of the wintertime heat loss is around the windows and doors.

Whether this deficiency is the result of carelessness, the lack of a desire to do a good job, an attempt to reduce costs by reducing labor hours or some other reason is of no real consequence. The result, in any case, is that the home owner will ultimately pay for this deficiency by higher fuel bills. Perhaps even more important, the national conservation of energy objective will be frustrated.

If the problem is one of attitude, it is unlikely to change. However, it is believed that home builders will adopt a new idea that will solve this problem if it does not significantly increase their costs, which is the basic concept of this invention.

Conservation of energy has become so essential that on Dec. 3, 1974 the U.S. Congress passed the Federal Non-Nuclear Energy Research and Development Act, under which there is established a national energy program to develop (1) new energy sources and (2) more efficient uses of existing energy sources. Implementation of this program is the responsibility of the Energy Research and Development Administration.

Under this program, the National Bureau of Standards was assigned the role of evaluating energy-related inventions for the purpose of identifying the most promising developments that may warrant ERDA financial support. It is reported that among the first 36 inventions selected for consideration, out of the first 5000 requests for financial support evaluation, are inventions relating to more efficient use of existing energy sources, such as insulation material, conservation of electric power, use of waste heat, automatic setback of home thermostats, etc. This invention falls directly into that category of energy-related inventions.

It is becoming abundantly clear that conservation of energy has become so critical that every small saving is important, since the collective saving is substantial. This is not only because of the sharply increasing cost of energy, but also because supplies are being depleted at a substantial rate.

Accordingly, a main object of the invention is to provide a method or technique and a material or article of manufacture that will greatly increase the probability of installation of thermal insulation in air gaps such as those around window and door frames.

Another main object of the invention is to provide a prefabricated insulation tape that is adapted for such purposes.

A still further object of the invention is to provide prefabricated window and door frames having such insulation tape formed as a part thereof in factory manufacture of such frames, so that it is already in place when the frames are installed in the rough openings therefor.

Another object of the invention is to provide an insulation tape that comprises a strip of compressible thermal insulation retained in the compressed condition within an encasing envelope of tearable material, such as plastic or paper, the casing having at least one rip cord extending lengthwise thereof, as along one edge, whereby the envelope is torn lengthwise by pulling the rip cord, allowing the compressed insulation material to expand and fill the air gap to be insulated.

Another object of the invention is to provide such a tear-type insulation tape that can be mass produced and purchased in rolls or the like in lumber yards, hardware stores, etc., and installed on the window or door frame, or in the rough opening therefor, at the building site.

A still further object of the invention is to provide an insulation tape comprising a relatively heavy base strip of paper, plastic or the like, a strip of compressible thermal insulation on the base strip, the expanded or free thickness of the insulation being substantially equal to or approximating the width of the air gap to be insulated, and another relatively lighter or thinner strip of paper or plastic attached to the base strip while the insulation strip is substantially fully compressed, so that the insulation strip is retained in the compressed condition until the envelope of paper or plastic retaining strips are separated, as by tearing the same by pulling a rip cord formed therein, the heavier base strip tending to keep the tape from curling across the width thereof and providing means for stapling or otherwise securing the insulation tape to the frame or the rough opening.

Another object of the invention is to provide such insulation tape having one side (or both sides) thereof formed with pressure sensitive adhesive so that it may be secured thereby to a window or door frame and/or to the structural element forming the rough opening.

Still another object of the invention is to provide such an insulation tape having at least one rip cord formed on each edge thereof, to expand the insulation strip.

Still another object of the invention is to provide such a strip wherein the envelope is folded in compressing the insulation strip and the rip cord allows the insulation strip to expand by unfolding of the envelope, without tearing the same.

Some of the advantages of the invention are as follows:

1. Conservation of energy by insulation of the air gap in areas such as the air gap around window and door frames, by reducing heat transfer on the order of up to 90% by increasing the R factor to about 12 (2×4 wall) or 17 (2×6 wall) from the air gap R factor of 1.5.
2. Increasing the probability that such air gaps will, in fact, be insulated by making it convenient (in fact, part of the window and door installation procedure) and inexpensive to do the same.

3. Protection of the insulation material, during storage and at the building site, by the envelope until the window or door frame is installed and the rip cord is pulled.
4. Improve overall construction technique and quality of buildings.
5. Reduction of building site labor cost by including insulation tape in factory construction of window and door frames.
6. Compressing the insulation strip to its thinnest possible dimension conserves storage space and enables use where a minimum air gap between frame and rough opening structural members.

These and other objects and advantages of the invention will become more apparent upon reference to the following specification and the appended drawings.

DETAILED DESCRIPTION

Figure 1:
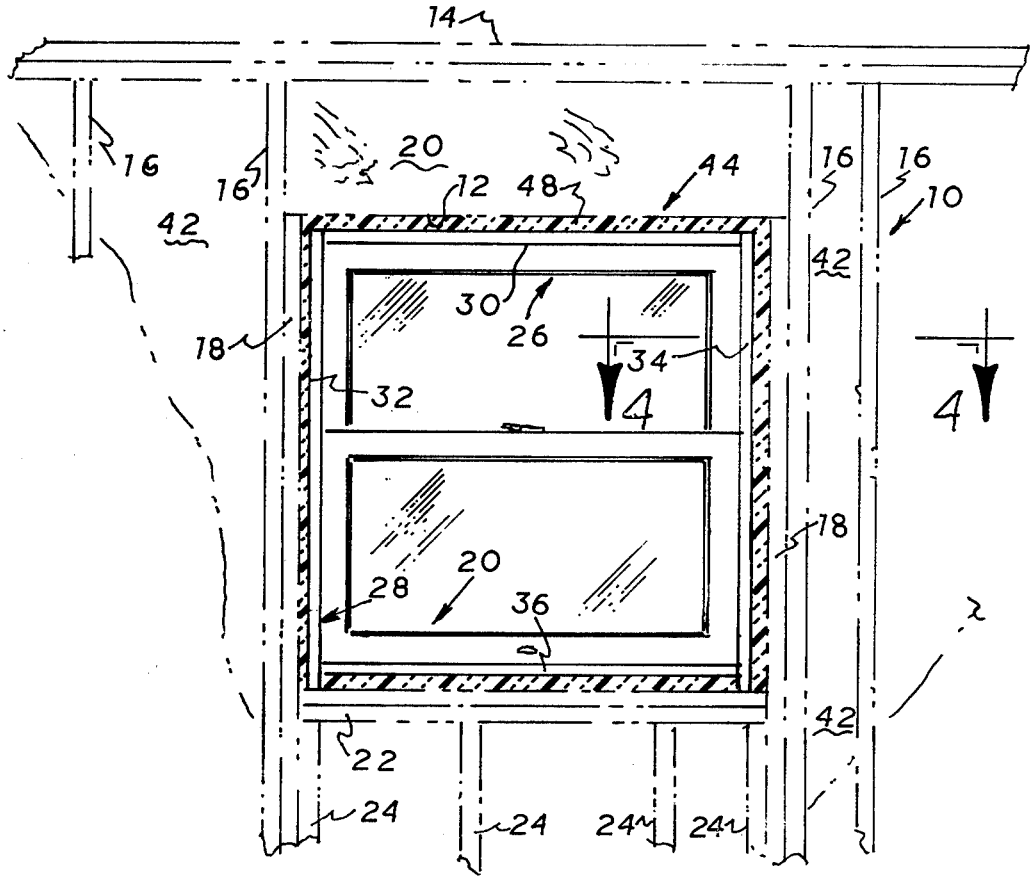
FIG. 1 is a fragmentary side elevational view of a building frame, taken from the inside thereof, with thermal insulation in the air gap between a window frame and the structural elements forming the rough window opening.

Reference is now made in greater detail to the drawings, which are illustrative only, and wherein like elements are designated by the same reference numerals.

FIG. 1 is a fragmentary portion of a building frame 10, taken from the inside thereof and including a window rough opening 12. The frame 10 includes a double top plate 14, studs 16, header support studs 18, header 20, double sill 22 and sill support studs 24.

Figure 4A:
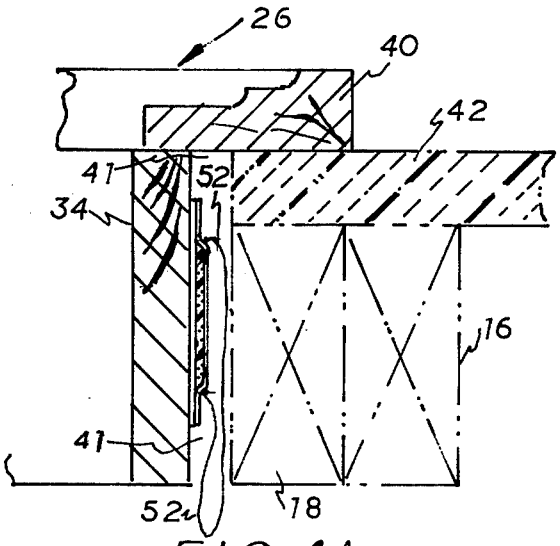
FIGS. 4A and 4B are enlarged cross-sectional views taken on the plane of line 4—4 of FIG. 1.
Figure 4B:
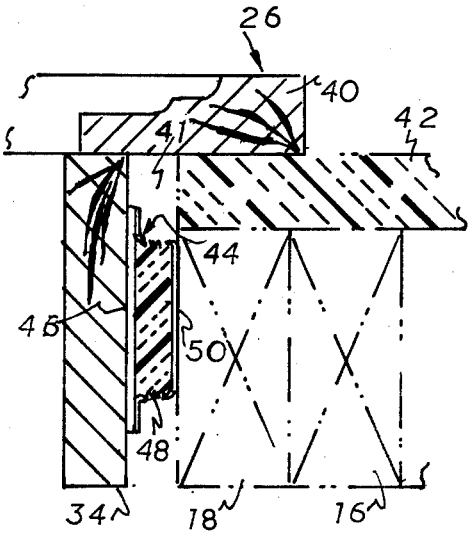
Figure 3:
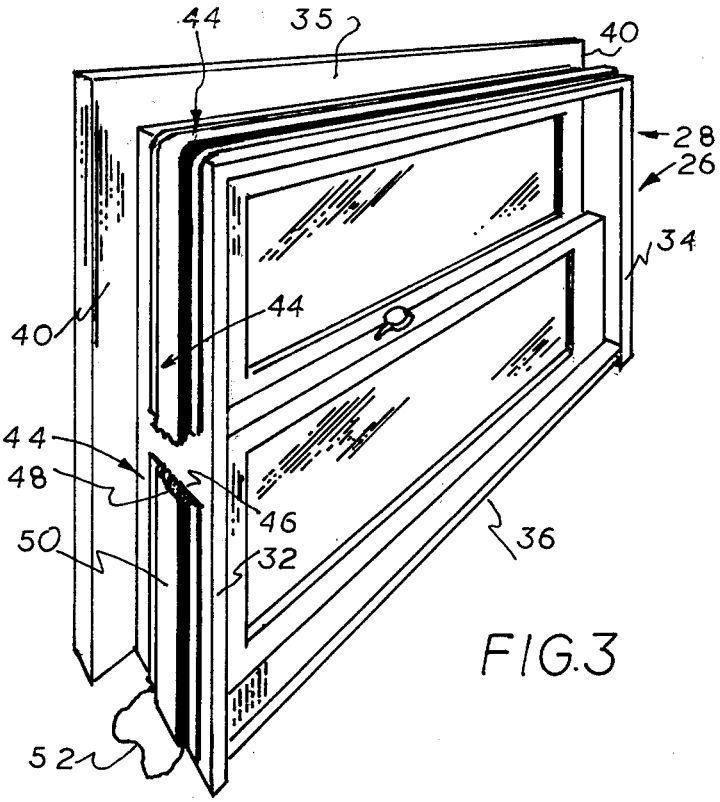
FIG. 3 is a perspective view of a window frame having mounted thereon insulation tape embodying the invention.

The rough opening 12, which is defined by studs 18, header 20 and sill 22, is fitted with a double hung window 26, including the window frame 28 comprising the head 30, jambs 32 and 34 and sill 36. As seen in FIGS. 3, 4A and 4B, the window includes a top casing 35 and side casings 40, by which the window is nailed to the studs 18 and header 20, through the sheathing 42, after the window frame 28 is properly squared-up and aligned in the rough opening 12. It is during this installation of the window that the ½"–1" air gap 41 (See FIGS. 4A and 4B) around the window frame is determined, the rough opening 12 being made roughly larger than the window frame 28 to allow such squaring-up and alignment.

Figure 2:
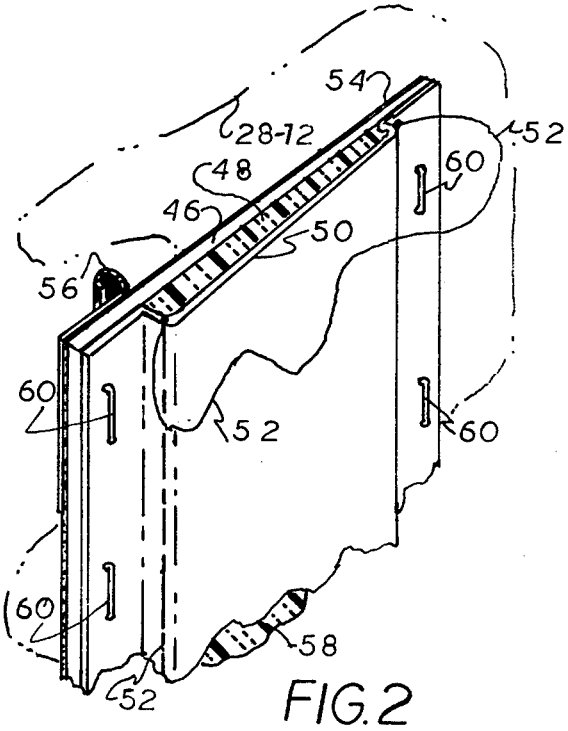
FIG. 2 is a fragmentary enlarged perspective view of a strip of insulation tape embodying the invention.

FIG. 2 is an enlarged perspective view of a strip of insulation tape 44 embodying the invention. The tape 44 comprises a base strip 46 of paper (possibly cardboard), plastic or other suitable material, a strip 48 of compressed insulation material, which may be any suitable compressible material, such as spun glass, certain polyurethane materials, etc., that expands or recovers to its approximate free state upon release of compressing pressure thereon, and another strip 50 of tearable paper or plastic, etc., the strip 50 being formed with rip cords 52 at each side thereof. The base strip 46 and the other strip 50 thus form an envelope that retains the insulation 48 in the compressed state and protects the same from damage until installation or use thereof is completed when the rip cord (or cords) 52 are pulled.

One possible method of inexpensively manufacturing tape 44 may be, for example, to continuously feed the strips 46, 48 and 50 between a set of heated rolls that simultaneously compress insulation strip 48 and heat seal the wider plastic strips 46 and 50 together, with the narrower compressed insulation strip 48 therebetween, the strip 50 having been manufactured with rip cord (or cords) 52. Obviously, there are many other methods of mass producing tape 44, the specific method depending, in part, upon the particular materials being employed. For example, if the strips 46 and 50 are cardboard and paper, respectively, then they may be formed with a pressure sensitive, thermoplastic or other adhesive that is caused to permanently secure strips 46 and 50, with the compressed insulation 48 therebetween, by suitable rolls or other similar equipment. At any rate, the specific method of manufacture of the tape 44, or the specific composition thereof, is not important to the invention.

It will be noted, in FIG. 2, that the tape 44 may have a pressure sensitive adhesive layer 54 on the outer surface of the base strip 46 by which the tape 44 can be secured to the frame 28 or interior of the opening 12. For tape 44 to be purchased for use at the job site, as opposed to installation at the factory, the adhesive would include the usual protective paper layer 56 to be removed to expose the adhesive 54. If so desired, the strip 50 may also have a pressure sensitive adhesive 58, which will adhere to the other side of the air gap structure upon expansion of the insulation 48. In lieu of adhesive 54, the tape 44 may be secured by any other suitable known means, such as staples 60.

It will be noted that strip 46, whether it be cardboard, plastic, etc., is shown as being thicker than strip 50. This is so that staples 60 will better retain the tape 44, and so that the tape 44 does not tend to bow or curl transversely under the pressure of the compressed insulation 48 tending to expand.

In FIG. 3, the tape 44 is shown as part of a prefabricated window 26, it being understood that the tape 44 would be secured along the jambs 32 and 34, the head 30 and the bottom of sill 36.

In FIG. 1, the insulation strip 48 is shown between the window frame 28 and the edges of the rough opening 12.

In FIG. 4A, the insulation tape 44 is shown in the air gap 41 (attached to jamb 34) still in the compressed state, before either of the rip cords 52 are pulled to tear the envelope. In FIG. 4B, the rip cords 52 have been pulled to tear the strip 50 and allow insulation strip 48 to expand to fill the air gap 41.

It is important to note that after the window 26 has been installed, all that the carpenter, or carpenter helper, has to do to insulate the air gap 41 is to pull the rip cord 52. Without the tape 44, it is necessary to take the considerable time to hand stuff bulk insulation into the air gap 41, which is presently not being done, as stated above. The minimal combined cost of providing tape 44 on the factory-built window 26 and pulling the rip cord (or cords) 52 is considerably less than the cost of hand stuffing bulk insulation into the air gap 41. Far more important, the convenience of tape 44 will help to assure that the gap 41 is, in fact, insulated.

Figure 5:
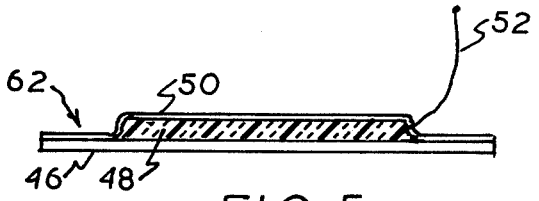
FIGS. 5 and 6 are enlarged cross-sectional views of a modified insulation tape before and after the single rip cord is pulled to expand the insulation.
Figure 6:
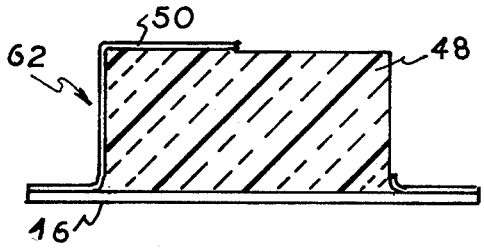
Figure 7:
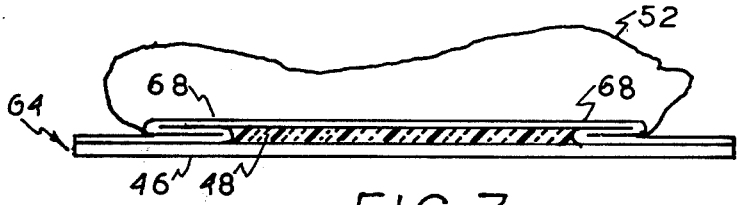
FIGS. 7 and 8 are views similar to FIGS. 5 and 6 of another modification of insulation tape embodying the invention.

FIGS. 5 and 6 illustrate a modified insulation tape 62, wherein there is only a single rip cord 52 extending along only one side of the tape. Otherwise, tape 62 is generally similar to tape 44. Where there is no access to one side of the tape 44, as in FIGS. 4A and 4B, then the one-rip cord modification of FIGS. 5 and 6 may be employed, with the rip cord 52 being on the accessible side. Alternatively, if the rip cords 52 are joined at one end of the tape, as shown in FIGS. 4A and 7, then both sides of the strip 50 can be torn at the same time. The rip cord 52 may be formed at any portion of strip 50 adjacent the insulation strip 48. In FIG. 6, it is noted that strip 50 remains attached to base strip 46 when rip cord 52 is pulled. Tape 62 may also have the pressure sensitive adhesive layers 54/56 and 58 of FIG. 2, and, as already stated, the strips 46, 48 and 50 may be of any suitable material.

Figure 8:
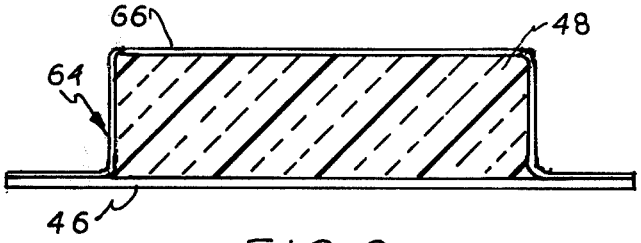

FIGS. 7 and 8 illustrate another modified tape 64, wherein the strip 50 of FIGS. 2, 5 and 6 is replaced by a strip 66 that includes folded portions 68 retained by rip cords 52. When the rip cords 52 are pulled, the tape assumes the configuration of FIG. 8, to fill the air gap 41. If only one rip cord 52 of FIG. 7 is pulled, the tape 64 assumes a configuration similar to that of FIG. 6.

It will be noted that in all modifications of the insulation tape 44, there is at least one side base strip 46 edge along which the tape may be stapled without stapling the insulation strip 48.

As stated, the drawings are only illustrative of the invention. It is apparent that the use of the tapes 44, 62 and 64 is not limited to heat insulation of air gaps around window and door frames. There may be other similar applications for such thermal insulation tape, where permanent heat insulation of narrow air gaps created by inserting a member into an opening, etc., is required. Also, the specific detailed structure of the tape may be varied. The main feature of the invention is a prefabricated compressed thermal insulation that can be released to expand and insulate an air gap, against heat transfer out of or into a building, for example.

The invention has been shown and described in such clear and concise terms as to enable anyone skilled in the art to practice the same, and no limitations are intended, except as recited in the appended claims.

What I claim as my invention is:

1. An energy conserving structural element, comprising an outer frame adapted to be inserted into an opening therefor with sufficient clearance to leave a relatively narrow air gap around said frame, said element having a strip of compressed expandable thermal insulation attached substantially around the outer periphery of said frame, said insulation strip having enveloping means to maintain the same in a compressed condition, said enveloping compressing means being easily tearable so as to be capable of being rendered inoperative so as to allow said strip to expand to substantially fill said air gap.

2. A structural element such as that recited in claim 1, wherein said element comprises a window frame.

3. A structural element such as that recited in claim 1, wherein said element comprises a door frame.

4. An energy conserving insulation product adapted to provide thermal insulation of air spaces, such as the air gap between window and door frames and the structural elements forming the rough opening therefor, said product including means comprising material that has thermal insulation properties better than that of the air gap and that is compressible from its free expanded state and will expand to essentially its former free state upon release of the compressing pressure, and enveloping means forming a part of said product retaining said material in a substantially compressed state until said retaining means is rendered inoperative to allow said material to expand toward its free state in said air gap, said enveloping means being tearable to render the same inoperative.

5. An energy conserving structural element normally used in combination with other structural elements in a manner such that a relatively narrow air gap that should be thermally insulated is created between elements, said element comprising a structural member having thermal insulation means secured thereon on the side thereof that will define the air gap, said insulation means comprising compressed expandable thermal insulation material having enveloping means retaining the same in the compressed state, said enveloping retaining means being capable of being rendered inoperative so as to allow said insulation material to expand, said insulation material, in its expanded state, having a thickness to substantially fill the air gap.

6. The structural element recited in claim 5, wherein the free state expanded thickness of said insulation strip is at least equal to the widest anticipated air gap to be insulated, whereby air gaps of varying width up to and including the widest gap will be insulated.

7. A method of thermally insulating the air gap between a window, door or other frame and the structural elements forming the rough opening therefor, said method comprising the following steps:

a. Fixing a strip of compressed expandable thermal insulation material either to the outer periphery of said frame or to the inner periphery of said elements forming said rough opening;
b. Inserting said frame into said rough opening to provide said air gap; and
c. Releasing said compressed insulation material so that it can expand and fill said rough opening air gap.

8. An energy conserving thermal insulation tape adapted to provide thermal insulation of narrow spaces, such as the air gap between window and door frames and the structural elements forming the rough opening therefor, said tape including thermal insulation means comprising a continuous strip of thermal insulation material that may be compressed from its free expanded state and that will expand to essentially its former free state upon release of the compressing pressure and means retaining said continuous strip of insulation material in a substantially fully compressed state, said retaining means forming a part of said tape and being capable of being rendered inoperative, whereby said strip is released to expand to its free state.

9. A thermal insulation tape such as that recited in claim 1, wherein said retaining means comprises a tearable envelope.

10. A thermal insulation tape such as that recited in claim 4, said envelope being formed with at least one rip cord, whereby pulling said rip cord tears said envelope lengthwise to release the compression pressure on said insulation strip and allow the same to expand to its uncompressed free state.

11. A thermal insulation tape such as that recited in claim 1, wherein said retaining means comprises a base strip and a tearable strip disposed on opposite sides of said insulation tape.

12. A thermal insulation tape such as that recited in claim 11, wherein said tearable strip is formed with at least one rip cord extending the length thereof adjacent said insulation strip, whereby pulling said rip cord tears said tearable strip lengthwise to release the compression pressure on said insulation strip and thereby allow the same to expand to its uncompressed free state.

13. A thermal insulation tape such as that recited in claim 11, wherein said base strip is structurally relatively stiff as compared to said tearable strip, so as to resist the tendency of said tape to curl transversely under the pressure of said compressed insulation strip.

14. A thermal insulation tape such as that recited in claim 5, said base and tearable strips being wider than said insulation strip and secured together at their side edges with said compressed insulation therebetween.

15. A thermal insulation tape such as that recited in claim 6, wherein said base strip extends laterally beyond at least one side of said insulation strip to provide a base strip portion by which said tape can be stapled to a frame or other member without stapling said insulation strip.

* * * * *